US007647852B1

(12) United States Patent
Rinner

(10) Patent No.: US 7,647,852 B1
(45) Date of Patent: Jan. 19, 2010

(54) RATCHET SCREWDRIVER AND CONNECTION ARRANGEMENT

(76) Inventor: James H. Rinner, 585 92$^{nd}$ St., Franksville, WI (US) 53126

( * ) Notice: Subject to any disclaimer, the term of this patent is extended or adjusted under 35 U.S.C. 154(b) by 0 days.

(21) Appl. No.: 12/291,426

(22) Filed: Nov. 10, 2008

(51) Int. Cl.
*B25B 13/46* (2006.01)
*B25B 23/16* (2006.01)

(52) U.S. Cl. ..... 81/62; 192/43.1

(58) Field of Classification Search ..... 81/62, 81/DIG. 5, 58.4, 63.1; 192/44, 45, 45.1, 192/54.2
See application file for complete search history.

(56) References Cited

U.S. PATENT DOCUMENTS

| | | | | | |
|---|---|---|---|---|---|
| 791,895 | A | | 5/1905 | Furbish | |
| 878,657 | A | | 2/1908 | Munch | |
| 3,337,014 | A | * | 8/1967 | Sandrick | 192/43.1 |
| 4,777,852 | A | | 10/1988 | Herman | |
| 5,437,212 | A | | 8/1995 | Thompson | |
| 5,687,820 | A | | 11/1997 | Lin | |
| 5,749,272 | A | | 5/1998 | Phan | |
| 5,848,680 | A | * | 12/1998 | Rinner | 192/43.1 |
| 6,047,801 | A | * | 4/2000 | Liao | 192/43.2 |
| 6,047,802 | A | | 4/2000 | Huang | |
| 6,070,501 | A | * | 6/2000 | Braun et al. | 81/62 |
| 6,206,160 | B1 | | 3/2001 | Chen | |
| 6,227,077 | B1 | * | 5/2001 | Chiang | 81/63.1 |
| 6,301,999 | B1 | | 10/2001 | Garg | |
| 6,305,250 | B1 | | 10/2001 | Huang | |
| 6,644,147 | B1 | | 11/2003 | Huang | |
| 6,901,669 | B1 | * | 6/2005 | Liberatore | 30/540 |
| 6,948,605 | B1 | | 9/2005 | Gauthier | |
| 6,997,084 | B1 | | 2/2006 | Gao et al. | |
| 7,036,399 | B1 | * | 5/2006 | Gao et al. | 81/58.4 |
| 7,055,411 | B2 | * | 6/2006 | Huang | 81/63.1 |
| 7,156,216 | B2 | * | 1/2007 | Gauthier | 192/43.1 |
| 7,168,342 | B2 | * | 1/2007 | Gao et al. | 81/58.4 |
| 7,174,810 | B1 | * | 2/2007 | Lin | 81/63.1 |
| 2004/0154439 | A1 | | 8/2004 | Tuan-Mu | |
| 2006/0075621 | A1 | | 4/2006 | Gao | |
| 2008/0082106 | A1 | * | 4/2008 | Doll et al. | 606/104 |

* cited by examiner

*Primary Examiner*—David B Thomas
(74) *Attorney, Agent, or Firm*—Arthur N. Hansmann

(57) ABSTRACT

A ratchet screwdriver having an handle (10) and two pivotal pawls (26, 27) and a selector (51) rotatable relative to the handle for actuation of the pawls relative to a gear (18). The selector and gear are axially connected together and are arranged to be disassembled as a sub-assembly from the remainder of the screwdriver for cleaning the screwdriver. The pawls are mounted to pivot in parallel planes and on opposite sides of a radial plane extending along a longitudinal axis of the screwdriver, and they have V-shaped teeth for gear engagement. There is permanent indicia on the screwdriver showing four settings for the screwdriver, including a cleaning setting.

6 Claims, 8 Drawing Sheets

SELECT
CLEAN
10
11
18
A
8
71
41
38
51
61
39
34

10
22
13

10

10
11
11

10
20
24
14
A
18
68
67

SELECT
CLEAN
10
43
44
51
R
26
57
46
47
82
19
27
49
50

RATCHET SCREWDRIVER AND CONNECTION ARRANGEMENT

This invention relates to a ratchet screwdriver and its connection arrangement. It includes features desired for a screwdriver for use in the medical industry.

BACKGROUND OF THE INVENTION

The prior art is already aware of ratchet screwdrivers which have precision features suitable for use in the medical industry, for instance. The present invention improves upon the prior art in that it provides a ratchet screwdriver which is exemplary precise in its construction and use, and is capable of transmitting substantial amounts of torque with only the user's hand forces.

The ratchet teeth have a spacing less than that in the prior art and they are thus smooth in their action. Rotating a selector to the clockwise direction, namely to the right, will produce clockwise, that is right-hand, drive. Further, permanent indicia on the screwdriver shows the usual three operative settings. The screwdriver has a fourth permanent indicia which shows a setting for disassembly of the screwdriver for purpose of on-site cleaning and sanitizing in the medical usage. In that disassembly, all parts are retained in two sub-assemblies, and there are no loose parts. Also, the screwdriver is easily and readily reassembled on site.

In the above sanitizing, there is no requirement for special tools nor skills, so the user can readily and easily do the disassembly, cleaning, and subsequent reassembly. All that can be accomplished and the screwdriver does not require any lubrication for its precise and smooth action.

There is also the inherent method of assembling and disassembling the screwdriver, and communicating to the user, with indicia on the screwdriver, how those functions are accomplished. All in a readily understandable manner and without the need for any special tool.

DETAILED DESCRIPTION OF THE PREFERRED EMBODIMENT

Figure 1:
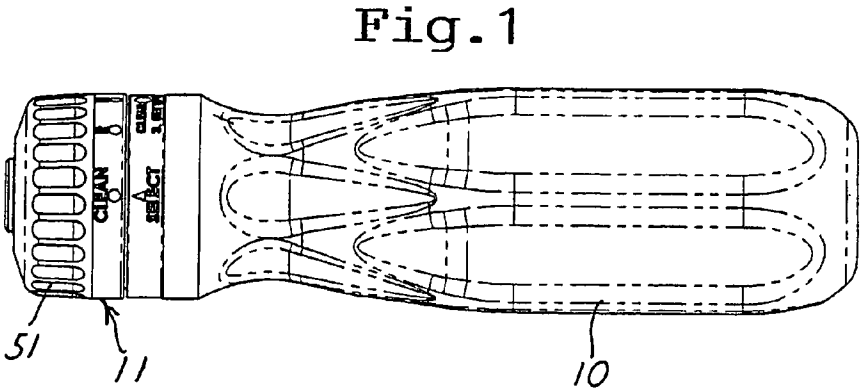
FIG. 1 is a side elevation view of a screwdriver of this invention.
Figure 2:
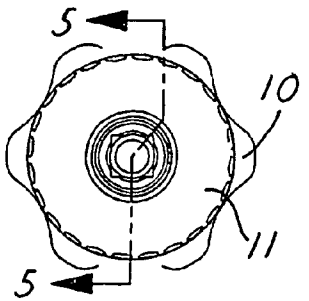
FIGS. 2 and 3 are respectively front and rear elevation views of FIG. 1.
Figure 3:
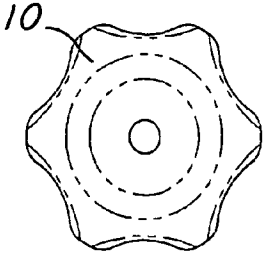
Figure 4:
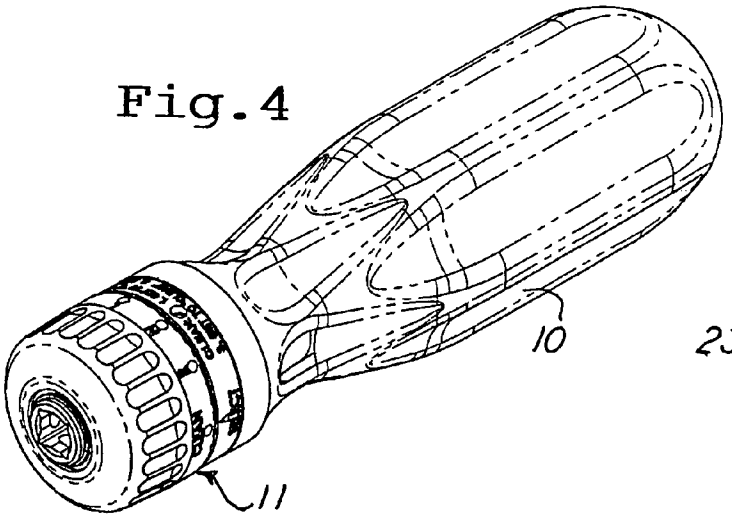
FIG. 4 is a front perspective view of FIG. 1.
Figure 5:
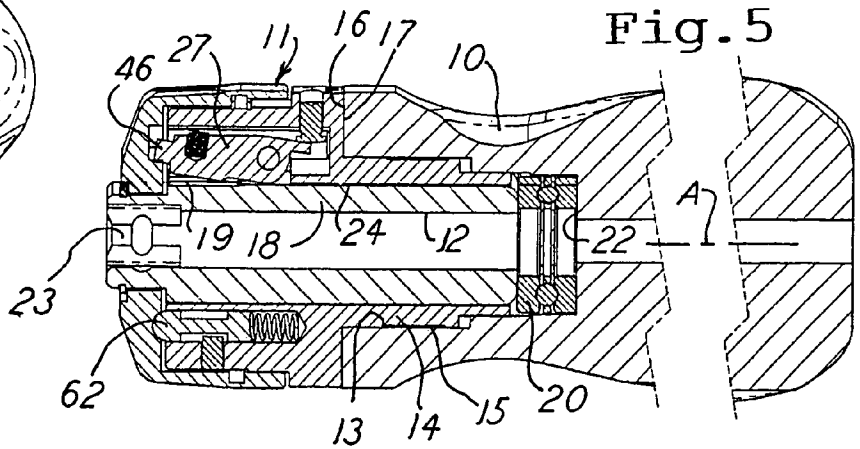
FIG. 5 is a slightly enlarged fragmentary section view taken on a plane designated by the line 5-5 of FIG. 2.

The screwdriver includes an elongated handle 10 and a ratchet section 11 with all extending along an axis A. The operator can grip the handle 10 and simultaneously operate the section 11 with thumb and a finger, all to set the driver in a selected operative mode while holding the handle 10. The entire driver, as seen in FIG. 5, has a passageway 12 completely therethrough for cannulation if desired.

The handle 10 has a cylindrical opening 13 which snugly receives an insert 14 having cylindrically disposed splines 15 for fixed connection of the insert 14 with the handle such that the handle 10 and insert rotate in unison about the axis A and under the influence of the operator's hand. A circular end wail 16 on the handle abuts a circular wall 17 on the insert 14 and thereby establishes the axial relation between the handle and the insert.

A cylindrical gear piece 18 has gear teeth 19 exteriorly thereon, and the insert 14 rotatably snugly and fully receives the gear 18. A shown ball bearing 20 abuts the gear end 21 and the handle wall 22 for axially stabilizing the gear and providing for free rotation of the gear in the handle. Also, the gear 18 has a driver configuration at 23 for receiving an unshown but conventional work piece such that the gear can rotate the work piece, such as a screwdriver bit. Also, the gear 18 is rotatably supported in a cylindrical opening 24 in the insert 14.

Figure 6:
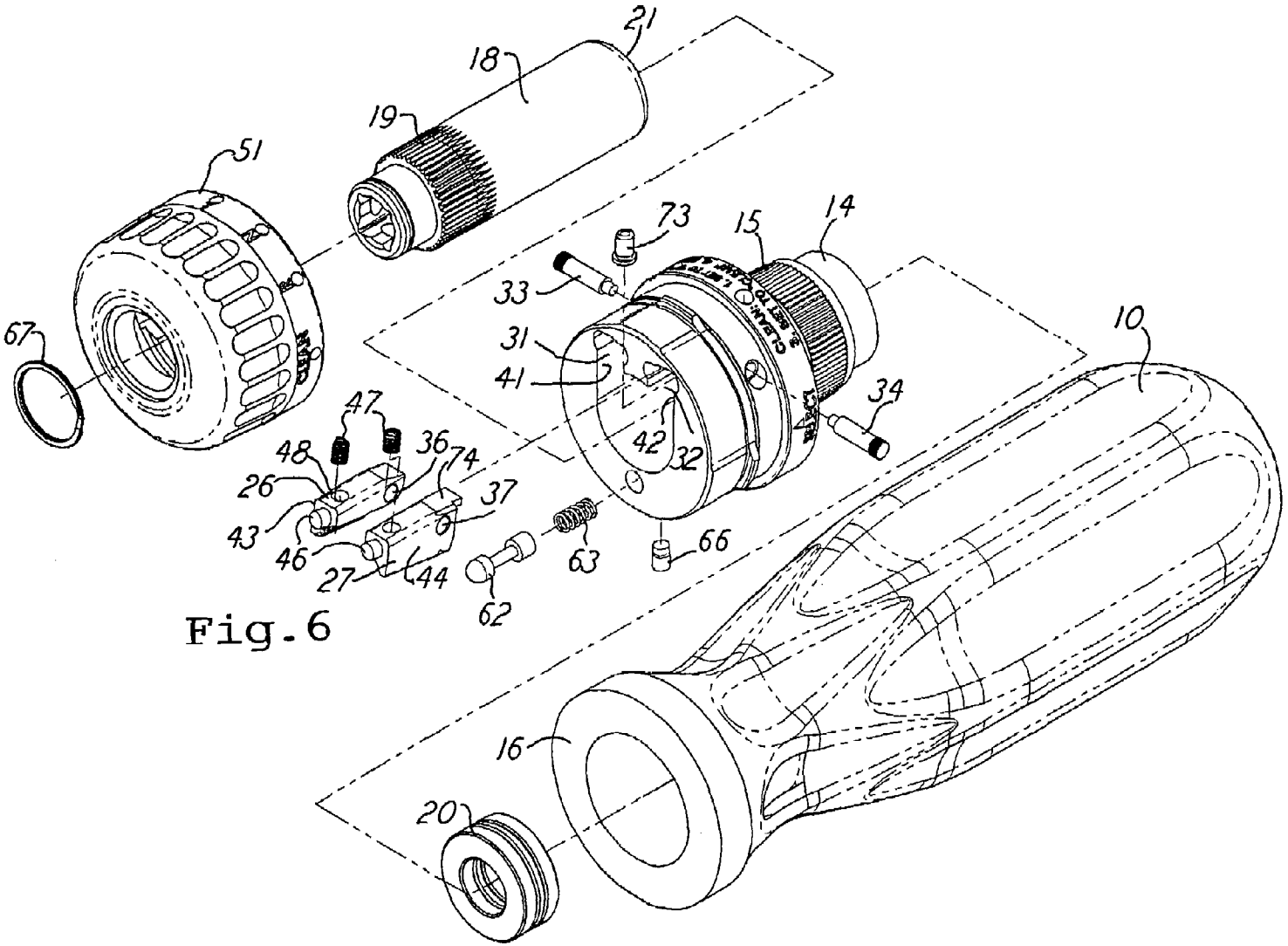
FIG. 6 is an enlarged exploded front perspective view of the screwdriver shown in FIG. 1.

FIG. 6 shows the insert 14 pivotally supports two pawls 26 and 27 which orbit about the axis A with the rotation of the insert 14. Teeth 28 on each pawl can engage the gear teeth 19 for rotation of the gear piece 18 with the insert 14, as desirably selected. Thus the insert 14 has two pockets 31 and 32 for respective pivotal reception of the pawls 26 and 27. The insert 14 carries two pawl pivot pins 33 and 34 which extend tangentially relative to the gear 18 and which extend into openings 36 and 37 in the pawls for the pivotal mounting of the pawls for pivoting in respective planes extending tangentially relative to the gear. The pawls are not aligned on a central radial plane relative to the gear 18 but instead they are offset in positions on opposite sides of a central plane from the gear, thus the term tangential. The teeth on the gear and on the pawls extend along a common arc and can be spaced apart at 7.5 angular degrees per tooth and thus produce smooth engagement action. Exterior teeth on the gear are on the circular configuration, and the pawl teeth can extend on the circular configuration for flush meshing engagement with the gear teeth throughout at least several meshing teeth.

Figure 14:
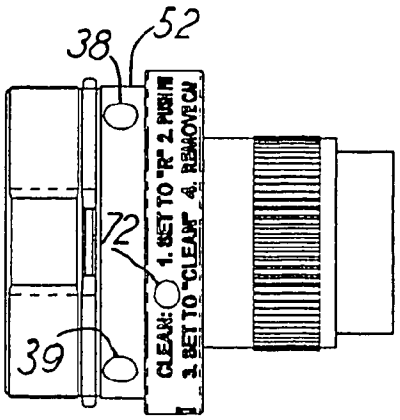
FIG. 14 is a top plan view of FIG. 13.

The pivot pins 33 and 34 respectively extend through the FIG. 14 two openings 38 and 39 in the insert 14, and the pins can be pressed into the insert 14 and they provide a tangentially extending pivot axis for each respective pawl and relative to the gear 18. Also, the insert pockets 31 and 32 are in part defined by planar walls 41 and 42 for respective snug and flush contact support for the respective pawls in the respective left and right driving rotation action of the particular pawl. So the pawls have respective planar walls 43 and 44 for flush contact with the planar walls 41 and 42 and to be orbited thereby.

So the pawls 26 and 27 are left hand and right hand pawls relative to the drive direction, and they are mirror images in configuration, and they each have a cylindrical cam follower 46 extending parallel to the axis A. Also, each pawl has a compression spring 47 engaged therewith to urge the pawls radially inwardly. The springs 47 sit in a respective opening 48 in each pawl, and the springs are also supported against the insert 14 to thereby bear radially inwardly onto the pawl.

Not fully shown herein, but it should be understandable by one skilled in the art, a plurality of each of the pawls 26 or 27 can be manufactured out of a hollow cylindrical base wherein the pawl teeth 28 can be formed to extend in the herein shown axial direction and on the cylindrical bases interior wail which defines the hollow interior. Also, the cam followers 46 can be formed on the cylinder at circular locations spaced around the end wall of the cylinder. Finally, the pawl side walls, such as 43 and 44, can be formed in the cylinder, and the cylinder can then be cut into segments which each include a cam follower 46 and thereby also each include a set of interior pawl teeth 28. The process can be repeated on another cylinder for the manufacture of a plurality of the other of the pawls 26 or 27. That assures arcuity, precision, and uniformity of the pawls and their teeth.

There is shown indicia for three operative settings for the driver, namely, L for left drive, which is counterclockwise, and R for right drive, which is clockwise, and N for neutral, which is drive in both directions. FIGS. 42 through 50 show these three settings. The insert has an indicator thereon, namely SELECT, with a shown arrow, and the three settings are on a selector cap 51 which is annular and thereby ring-shaped and rotatably mounted on the insert circular surface 52 with its interior circular wall 53. The insert also has indicia, as shown in FIG. 14, for instruction as to how to effect the release of the cap 51 from the insert 14, such as for cleaning the driver. The cap forms a front end closure for the driver.

The cap 51 and the insert 14 have mutually releasably engagable portions, and that can be the bayonet type tangs 54 and the tangs 56 respectively on the insert and the cap for relative offset and then rotated for aligned overlapping, all arranged to releasably restrict the axial movement of the cap relative to the insert. Of course, in the fully engaged relationship as mentioned above, the cap can rotate limitedly on the insert for the various setting markings to have the cap in the respective operative positions relative to the insert, with all in the fully assembled relationship. A limit to that rotation is established by the cam followers 46 of the pawls being disposed in a groove 57 in the cap 51. Abutment walls 58 and 59, defining the groove 57, present abutment walls to the pawl followers for that limit to cap rotation. Intermediate those abutment walls 58 and 59 is a cam 61 which is on the cap and orbits with cap rotation and into the path of the extensions of the cam followers 46. The cam 61 can thus lift the cam followers to pivot the pawls away from tooth engagement with the gear 18, as shown in FIGS. 44 and 50.

Figure 26:
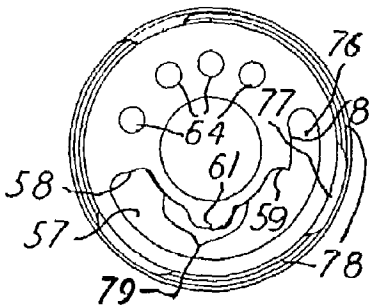
FIG. 26 is a rear elevation view of the part in FIG. 25.
Figure 18:
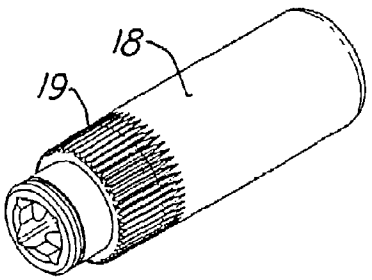
FIG. 18 is a perspective view of a part shown in FIG. 6.
Figure 19:
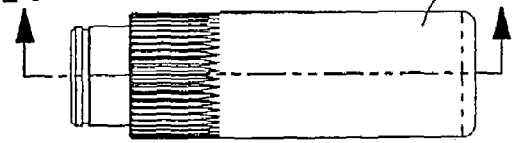
FIG. 19 is a side elevation view of FIG. 18.
Figure 20:
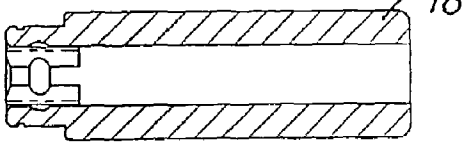
FIG. 20 is a section view taken on a plane designated by the line 20-20 of FIG. 19.

Also, a pin 62 extends between the insert and the cap and is spring-urged by a spring 63 to slide among the four recesses 64 in the cap, as labeled in FIG. 26, for releasably holding the cap in the four rotated positions relative to the insert, as selected. A plug 66 retains the pin 62 on the insert when the cap 51 is disassembled for cleaning.

Figures 8, 9, 10, 11:
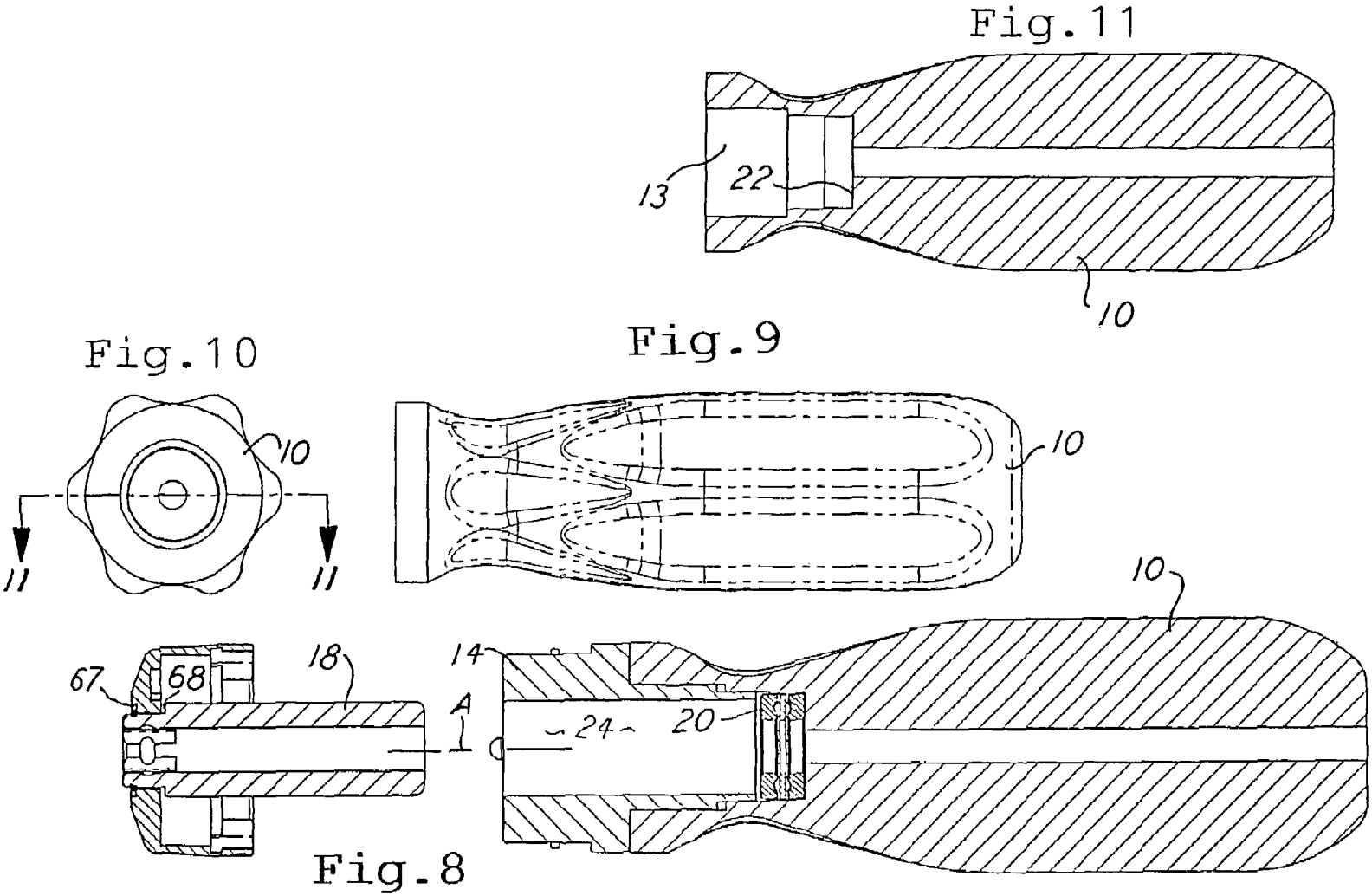
FIG. 8 is a section view taken on a plane designated by the line 8-8 of FIG. 7.
FIG. 9 is a side elevation view of only the handle shown in FIG. 1.
FIG. 10 is a front elevation view of FIG. 9.
FIG. 11 is a section view taken on a plane designated by the line 11-11 of FIG. 10.

The cap 51 and the gear 18 are axially connected together by a locking ring 67 which is a biaxial connector member as shown in a groove in the gear and in axial abutment with the cap. Also, the cap and gear present axial facing abutable surfaces for each other at 68 of FIG. 8. Thusly, the cap and gear are axially restricted relative to each other, but they are separately rotatable, and they are connected as one sub-assembly of the driver. The remainder of the driver constitutes the other sub-assembly of that two sub-assembly entire driver. With the disassembly such as shown in FIG. 7, the driver can be cleaned and/or sterilized in its interior.

Figures 42, 43, 44, 45, 46, 47, 48, 49, 50:
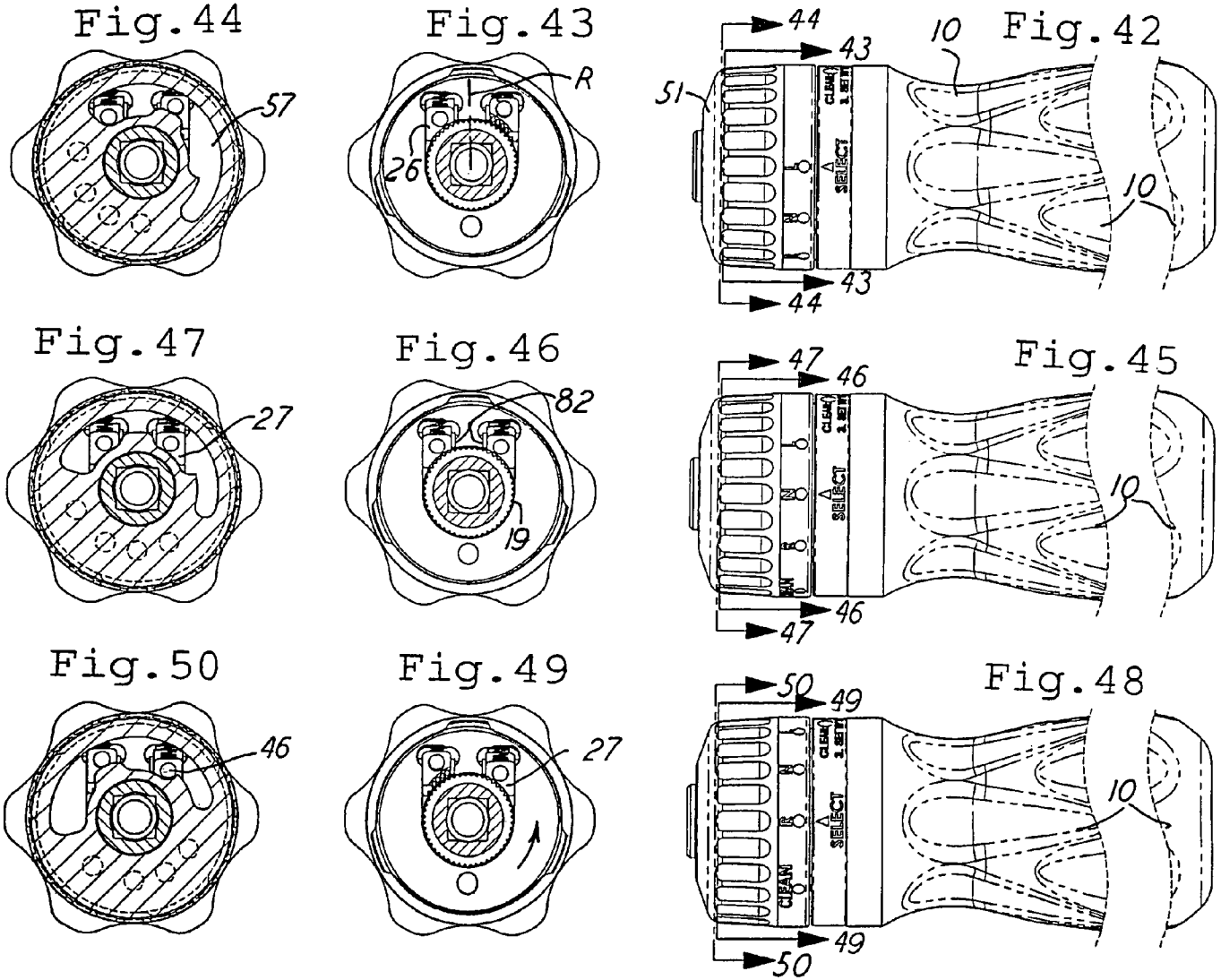
FIG. 42 is a side elevation fragmentary view of FIG. 1 in a setting slightly different from FIG. 1.
FIGS. 43 and 44 are section views taken respectively on the planes designated by the lines 43-43 and 44-44 of FIG. 42.
FIG. 45 is a side elevation fragmentary view of FIG. 1 in a setting slightly different from FIG. 1.
FIGS. 46 and 47 are section views taken respectively on the planes designated by the lines 46-46 and 47-47 of FIG. 45.
FIG. 48 is a side elevation fragmentary view of FIG. 1 in a setting slightly different from FIG. 1.
FIGS. 49 and 50 are section views taken respectively on the planes designated by the lines 49-49 and 50-50 of FIG. 48.

The three operative positions, namely left, neutral, and right, are shown in FIGS. 42 thru 50. FIG. 49 shows the driver in the R setting which is the right drive, clockwise from the handle end. Also, the follower for that driving cam 27 is abutting the abutment wall stop 59, so no further rotation of the cap is possible. However, if cleaning is desired, then a probe 71 of FIG. 37 is inserted into a radial extending opening 72 which is adjacent the indicia CLEAN on the insert. A plug 73 is radially movable on the insert in the opening 72, and the pawl spring 47 presses on the pawl flat end 74 and normally pivots the pawl radially outwardly against the plug to have the plug cover the hole 72 for protecting the driver interior from any contamination. The probe 71 contacts the plug which in turn contacts the pawl flat end 74 and pivots the pawl 27 to where its follower 46 is radially moved outwardly off the stop 59, as in FIGS. 38 and 39. That releases the cap for rotation to where the engaged tangs on the cap and the insert are no longer overlapping engaged. At that condition, the sub-assembly of the cap and gear can be removed from the remaining sub-assembly of the driver, as shown in FIG. 7. Reassembly of the entire driver is bringing the two sub-assemblies together, with the use of the probe, and then rotating for tang engagement. All can be readily done in the field by the driver user.

Figures 7, 37, 38, 39, 40, 41:
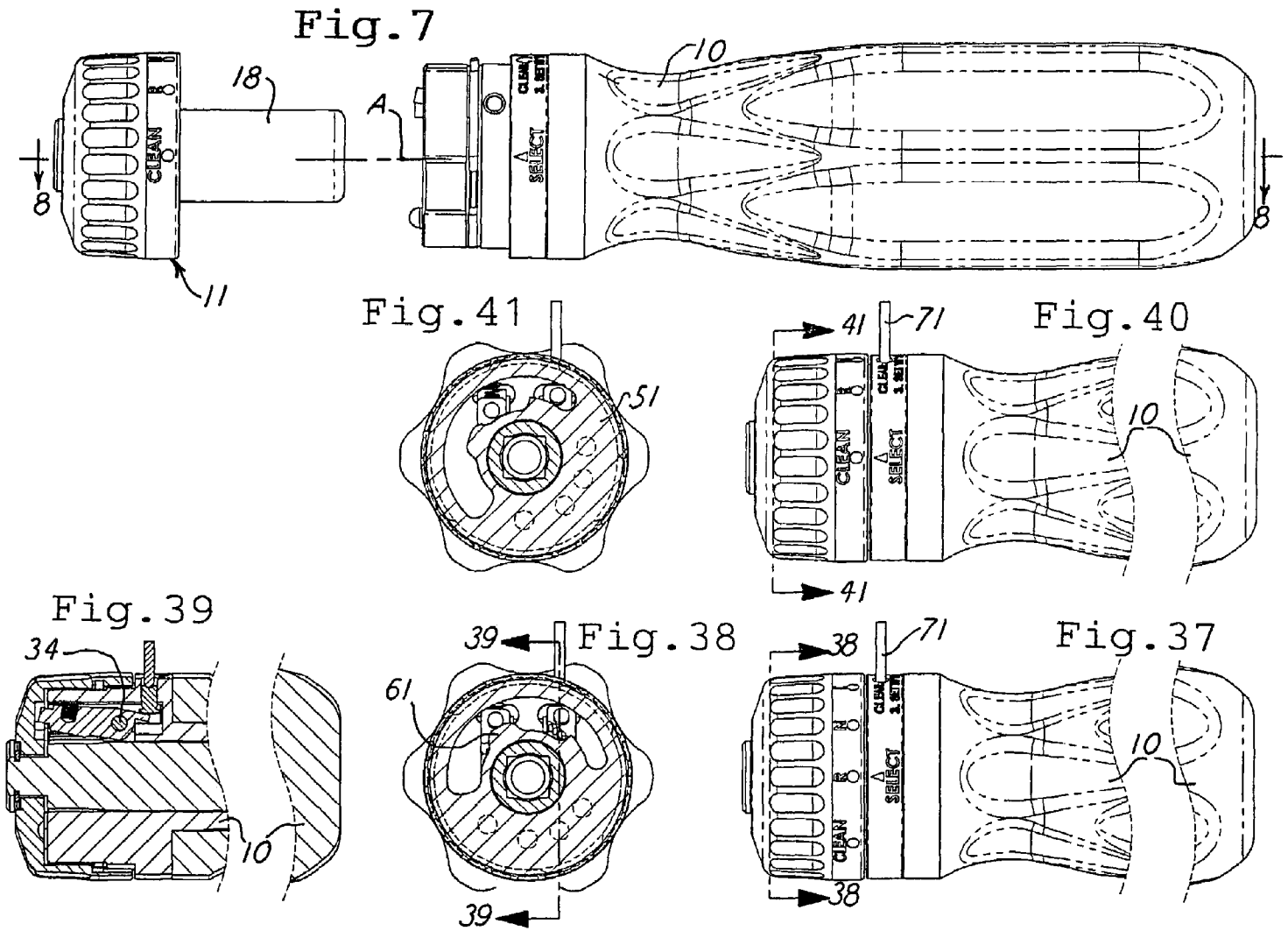
FIG. 7 is an enlarged side elevation view of the screwdriver shown in FIG. 1, shown in two sub-assemblies.
FIG. 37 is a side elevation fragmentary view of FIG. 1 in a setting slightly different from FIG. 1 and with a piece added thereto.
FIG. 38 is a section view taken on a plane designated by the line 38-38 of FIG. 37.
FIG. 39 is a fragmentary section taken on a plane designated by the line 39-39 of FIG. 38.
FIG. 40 is a side elevation fragmentary view of FIG. 1 with a piece added thereto.
FIG. 41 is a section view taken on a plane designated by the line 41-41 of FIG. 40.
Figure 15:
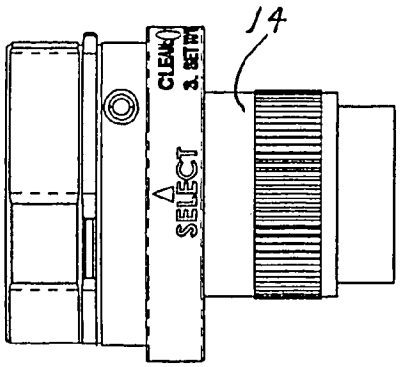
FIG. 15 is a side elevation view of 13.
Figure 13:
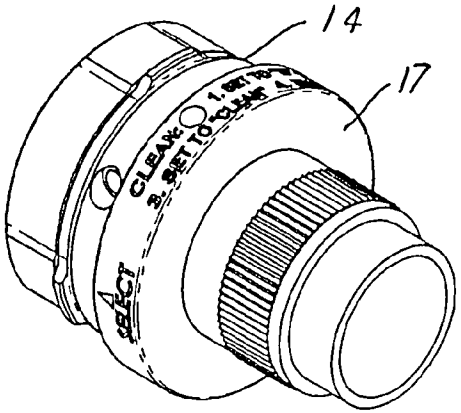
FIG. 13 is a rear perspective view of FIG. 12.

FIG. 41 shows the indicia for the four steps to be followed in the disassembly, namely, first set to R, which setting aligns the pawl 27 with the hole 72. Next, the probe 71 is pushed into the insert hole, then the cap is rotated to the position of aligning CLEAN indicia with the SELECT indicia. Then withdraw the cap. FIG. 15 shows the indicia SELECT on the insert for guiding the cap rotation in aligning the various settings shown and described above.

Figure 16:
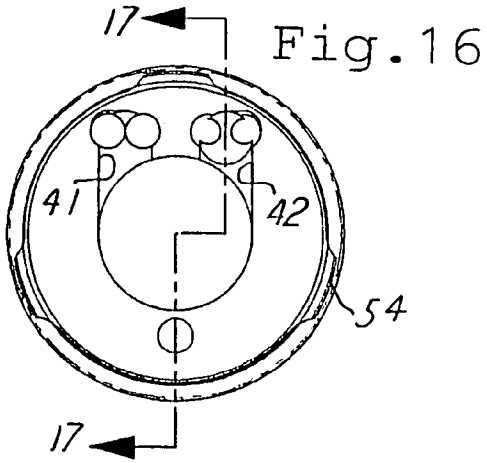
FIG. 16 is a left side elevation view of FIG. 15.
Figure 12:
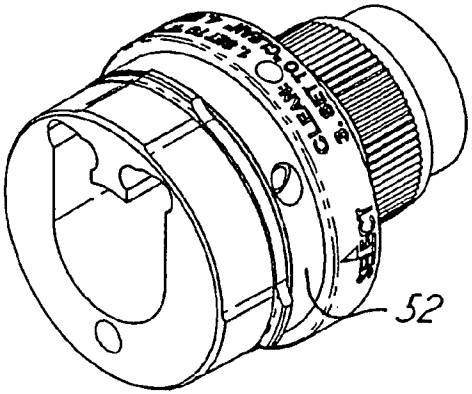
FIG. 12 is an enlarged front perspective view of a part shown in FIG. 6.
Figure 17:
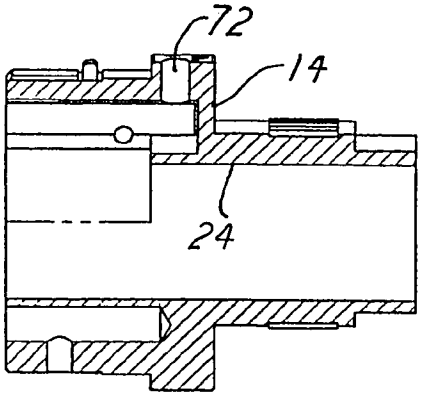
FIG. 17 is a section view taken on a plane designated by the line 17-17 of FIG. 16.
Figure 21:
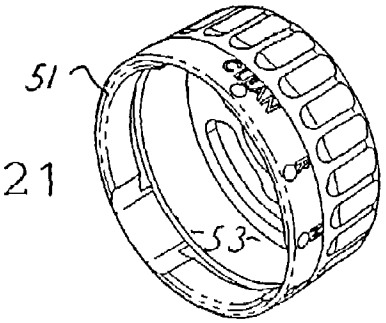
FIG. 21 is a rear perspective view of a part shown in FIG. 6.
Figure 22:
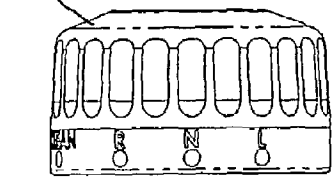
FIG. 22 is a side elevation view of FIG. 21.
Figure 23:
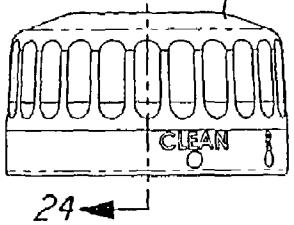
FIG. 23 is a top plan view of FIG. 21.
Figure 24:
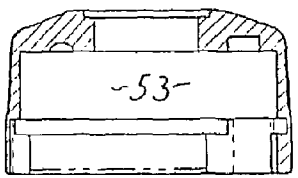
FIG. 24 is a section view taken on a plane, designated by the line 24-24 of FIG. 23.
Figure 25:
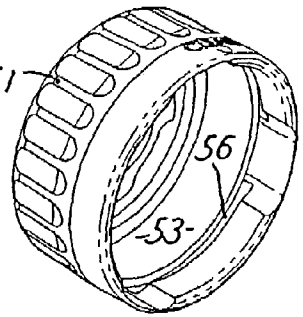
FIG. 25 is a rear perspective view of FIG. 21 but seen from a perspective different from FIG. 21.

In preference, and as shown in FIG. 43, there is a radial plane R extending along the axis, and the two pawls 26 and 27 are each fully disposed on opposite sides of that plane R as viewed along the axis A. The pawl pivot posts 33 and 34 lie along an axis which is perpendicular to that plane R. Thus, the pawls pivot only in the respective parallel planes which are tangential to the gear teeth 19. Also, only one cam 61 is required for pivoting both pawls 26 and 27, and in neutral it extends between the two pawls. The pawls have their respective teeth 28 disposed in an arcuate shape to thereby fully mesh and be in the same circular shape of the gear teeth 19. Also, the selector groove 57 has its end portion 76 extending circularly beyond the stop 59 for accommodating the additional rotation of the selector beyond the stop 59 for that release of the connection between the selector and the handle. FIG. 26 also shows that the end portion 76 is within the radial alignment of the gap 77 between the tangs 78 of the selector, for axial movement of the insert tangs 54 through the openings 77 in the axial removal of the selector from the handle. The tangs 54 on the insert 14 are shown in FIG. 16 to be equally spaced around the insert, and the gaps 77 for the axial passage of those tangs 54 through the gaps 77 are equally spaced around cap 51, so the rotation of the selector to receive the follower 46 in the end portion 76 presents the required alignment and the then axial release of the selector. That is with the indicia of CLEAN aligned with SELECT indicia.

FIG. 26 also shows that the cam 61 is central from the two stops 58 and 59. The groove 57 is defined by radially inward arcuate surfaces 79 but the followers 46 are free to move radially inwardly to where the pawl teeth 28 fully mesh with and rest upon the gear teeth 19. In the release of the pawl 27 off the stop 59, upon rotation of the selector, the follower 46 of the pawl 27 can slide on the surface 81 which holds the pawl 27 away from the stop 59 and thus in its released position beyond stop 59, as seen in FIG. 41. The teeth 19 and 28 are all V-shaped in axial view, and teeth 28 are on teeth 19 for an angulation of at least thirty degrees and move inward in their tangential planes into full teeth mesh. Also, springs 47 are located in line with the teeth 28 for firm mesh engagement. The pawl pockets 31 and 32 and the pawl thicknesses can present gaps 82 of FIG. 46, and the pawls can slide along the pivot pins 33 and 34 into gear full mesh.

Figure 27:
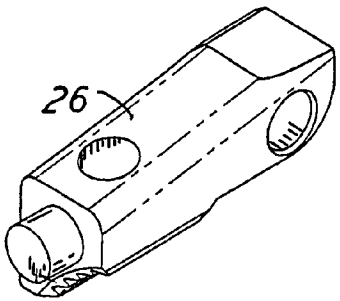
FIGS. 27 and 28 are enlarged perspective views of two parts shown in FIG. 6.
Figure 28:
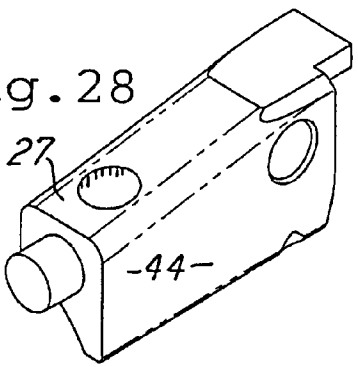
Figure 29:
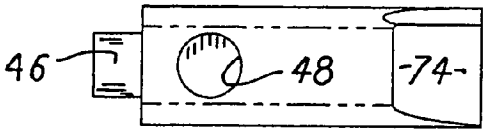
FIG. 29 is a top plan view of FIG. 27.
Figure 31:
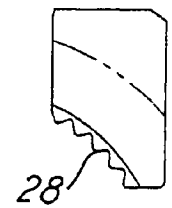
FIGS. 30, 31, and 32 respectively are front, right, and left elevation views of the part of FIG. 29.
Figure 30:
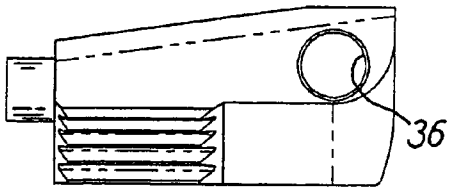
Figure 33:
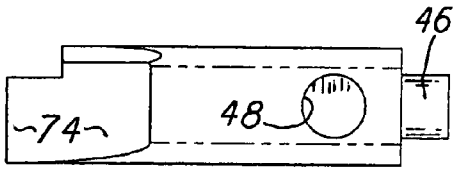
FIG. 33 is a top plan view of FIG. 28 but rotated as shown.
Figure 35:
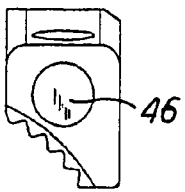
FIGS. 34, 35, and 36 respectively are front, right, and left elevation views of the part of FIG. 33.
Figure 34:
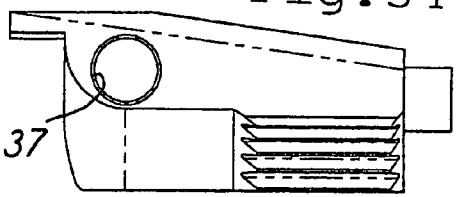
Figure 32:
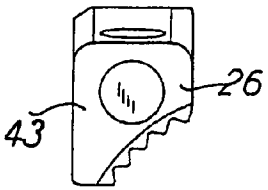
Figure 36:
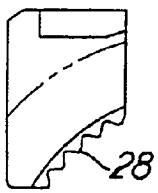

FIG. 5 shows the pawl 27 is limited in pivoting by its end 74 abutting plug 73, so when disassembled the spring 47 will not fall out. Likewise, the end 74 of FIGS. 27 and 29 for pawl 26 abuts the insert 14 so it spring 47 will not fall out.

The foregoing discloses a preferred embodiment, as is required, but those skilled in the art will know of changes which can be employed within the scope of this disclosure, and the claims present the scope of this invention protection.

What is claimed is:

1. In a ratchet screwdriver having a handle (10), a gear (18) connected with said handle, two pawls (26, 27) supported on said handle and being selectively engageable with said gear for rotating said gear about an axis (A) for driving a workpiece, a selector (51) releasably connected to said handle and operative on said pawls for moving said pawls relative to engagement with said gear, the improvement comprising:

said gear being movable along said axis for rotational assembly and being rotatable on said handle, a biaxial connector member (67) connected between said gear and said selector for locking said gear and said selector axially together in both axial directions and in a sub-assembly to be movable together in both axial directions along said axis for movement of said sub-assembly as a unit and relative to said handle for assembly with and removal from said handle for cleaning, a selector rotation abutment wall on said selector and a cam follower on one of said pawls and with said wall and said cam follower being contactable with each other upon rotation of said selector and thereby for rotation restriction of said sub-assembly and with said cam follower being releasable for rotation of said selector on said handle, tangs respectively on said handle and said selector and being axially engageable with each other for restricting axial movement of said selector relative to said handle, said selector with said gear being separable from said handle upon rotational relationship of said selector to said handle in a selected rotational position of said selector relative to said handle to where said tangs are clear of each other for axial release of said sub-assembly from said handle, and indicia "CLEAN" on said screwdriver revealing said selector rotated position on said handle and which is a second position rotatively beyond said first position and with said selector thereby being free of axial restriction with said handle which is for the separation of said sub-assembly from said handle.

2. The ratchet screwdriver as claimed in claim 1, further comprising:

additional indicia "R, N, L" on said screwdriver in addition to the indicia "CLEAN" and thereby showing the rotated position of said selector for respective right hand and neutral and left hand setting for the screwdriver drive, for a total of four indicia.

3. The ratchet screwdriver as claimed in claim 1 further comprising:

said screwdriver having an opening (72) exposed to said one of said pawls for contacting said one of said pawls for moving said one of said pawls out of the rotational path for rotation of said selector relative to said handle beyond said limited amount of rotation for the separation of said selector from said handle.

4. The ratchet screwdriver as claimed in claim 3, further comprising:

indicia (FIG. 14) on said screwdriver showing instruction for selector rotation and for probing of one of said pawls for release of said selector from said handle, and with said indicia being the said word "CLEAN".

5. The ratchet screwdriver as claimed in claim 1, further comprising:

each of said pawls being mounted on a pivot pin (33, 34) and being respectively pivotal on said pivot pins for meshing adjustment with said gear teeth, a spring (47) on each of said pawls for urging said pawls into tooth engagement with said gear, and said pawls having two ends (74) offset from said pivot pins for abutment, and thereby for restriction of pivoting, of said pawls relative to said handle in the disassembly mode and thereby retain said springs on said pawls.

6. The ratchet screwdriver as claimed in claim 1, further comprising:

a pin (62) mounted on said handle and extending into contact with said selector for the rotational positioning of said selector on said handle, and a plug (66) on said handle and extending into contact with said pin for holding said pin against disassembly from said handle when said selector is removed.

* * * * *